US011712100B2

(12) United States Patent
Arora et al.

(10) Patent No.: US 11,712,100 B2
(45) Date of Patent: Aug. 1, 2023

(54) PACKAGED DEODORANT STICK PRODUCT

(71) Applicant: Conopco, Inc., Englewood Cliffs, NJ (US)

(72) Inventors: Amit Arora, Leeds (GB); Frank Van Der Blom, Eindhoven (NL); Cornelius Sebastianus Maria Verhoeve, Veghel (NL)

(73) Assignee: Conopco, Inc., Englewood Cliffs, NJ (US)

( * ) Notice: Subject to any disclaimer, the term of this patent is extended or adjusted under 35 U.S.C. 154(b) by 174 days.

(21) Appl. No.: 17/424,272

(22) PCT Filed: Jan. 22, 2020

(86) PCT No.: PCT/EP2020/051524
§ 371 (c)(1),
(2) Date: Jul. 20, 2021

(87) PCT Pub. No.: WO2020/152224
PCT Pub. Date: Jul. 30, 2020

(65) Prior Publication Data

US 2022/0110433 A1 Apr. 14, 2022

(30) Foreign Application Priority Data

Jan. 23, 2019 (EP) ..... 19153386

(51) Int. Cl.
*A45D 40/20* (2006.01)
*A45D 40/00* (2006.01)

(52) U.S. Cl.
CPC ..... *A45D 40/00* (2013.01); *A45D 2040/005* (2013.01); *A45D 2040/0012* (2013.01); *A45D 2200/05* (2013.01)

(58) Field of Classification Search
CPC ..... A45D 40/20; A45D 2040/0012; A45D 2040/005; A45D 2040/0018
See application file for complete search history.

(56) References Cited

U.S. PATENT DOCUMENTS 2,913,103 A 11/1959 Isele
3,656,628 A 4/1972 Dulberg
(Continued)

FOREIGN PATENT DOCUMENTS

DE 9318425 5/1994
GB 598838 2/1948
(Continued)

OTHER PUBLICATIONS

Search Report and Written Opinion in EP19153386; dated Jun. 4, 2019.

(Continued)

*Primary Examiner* — Jennifer C Chiang
(74) *Attorney, Agent, or Firm* — Greenberg Traurig, LLP

(57) ABSTRACT

A packaged deodorant stick product comprising a deodorant stick composition mounted on an upper surface of a retaining member, a lower surface of the retaining member being reversibly connected to an upper surface of a holder enabling the deodorant stick product to be held in the human hand, wherein reversible connection between the retaining member and the holder is achieved by means of tongue and groove connection elements.

11 Claims, 2 Drawing Sheets

(56) References Cited

U.S. PATENT DOCUMENTS

| | | | | |
|---|---|---|---|---|
| 4,235,557 | A | 11/1980 | Hayes | |
| 4,915,234 | A | 4/1990 | Boeller | |
| 5,092,700 | A | 3/1992 | Susini et al. | |
| 5,496,122 | A | 5/1996 | Fattori | |
| 5,738,123 | A | 4/1998 | Szekely | |
| 5,799,667 | A | 9/1998 | Szekely | |
| 6,293,719 | B1 | 9/2001 | Ohba | |
| 8,651,308 | B1 * | 2/2014 | Sung | A45D 40/00 220/4.24 |
| 10,039,366 | B1 | 8/2018 | Facer et al. | |
| 10,492,586 | B2 | 12/2019 | Paquet | |
| 11,406,168 | B2 * | 8/2022 | Briana | A45D 40/02 |
| 2008/0145133 | A1 | 6/2008 | Facer | |
| 2017/0007003 | A1 | 1/2017 | Paguet | |
| 2017/0164716 | A1 | 6/2017 | Lee | |
| 2017/0215552 | A1 | 8/2017 | Keller et al. | |
| 2018/0027947 | A1 | 2/2018 | Quennessen et al. | |
| 2018/0072483 | A1 | 3/2018 | Meranus | |
| 2022/0160101 | A1 * | 5/2022 | Zhou | A45D 40/16 |
| 2022/0378175 | A1 * | 12/2022 | Van Der Blom | A45D 40/00 |

FOREIGN PATENT DOCUMENTS

| | | |
|---|---|---|
| JP | 10179250 | 7/1998 |
| WO | WO2005068308 | 7/2005 |
| WO | WO2007093286 | 8/2007 |
| WO | WO2013118969 | 8/2013 |
| WO | WO2017078745 | 5/2017 |
| WO | WO2018202385 | 11/2018 |

OTHER PUBLICATIONS

Search Report and Written Opinion in EP19153387; dated Jun. 4, 2019.

Search Report and Written Opinion in EP19204993; dated Jan. 31, 2020.

Search Report and Written Opinion in PCTEP2020051523; dated Mar. 17, 2020.

Search Report and Written Opinion in EP20193038 ; dated Feb. 10, 2021.

Search Report and Written Opinion in PCTEP2020079453; dated Nov. 11, 2020.

Search Report and Written Opinion in PCTEP2020051524; dated Mar. 17, 2020.

IRPR2 in PCTEP2020051523; Apr. 9, 2021.

Refills; MyMyro.com; 2023; 13 pages, retrieved 2023 from https://www.mymyro.eom/collections/all#refills.

* cited by examiner

PACKAGED DEODORANT STICK PRODUCT

RELATED APPLICATIONS

The present application is a national phase filing under 35 USC 371 of International Application No. PCT/EP2020/051524, filed on Jan. 22, 2020, which claims priority from European Patent Application No. 19153386.8, filed on Jan. 23, 2019, the contents of which are incorporated herein in their entirety for all purposes.

FIELD OF INVENTION

The field of the invention is packaged deodorant stick products, in particular the packaging/dispensers therefor.

BACKGROUND

The invention relates to a deodorant stick product (for example, a deodorant and/or antiperspirant product for application to human axillary regions) and associated packaging/dispenser. More specifically, the invention relates to a package/dispenser for deodorant stick products wherein the product is fully exposed for use on a support, which package does not require a structure for elevating the product out of the package for use.

It has been desired to provide improved packages for deodorant stick products, wherein the package is simple—that is, does not require a mechanism for elevating the product out of a housing, which mechanism increases cost of the package and makes the package more complex.

U.S. Pat. No. 5,496,122 (Mennen, 1996) discloses a replaceable stick deodorant package wherein the product is completely exposed on a retaining member and the process by which such products may be manufactured. The composition is held on a retaining member which is snap-fit assembled into a handle.

U.S. Pat. No. 4,235,557 (Ethyl Corp., 1980) discloses a dispensing device for a hot-filled solid product, such as an antiperspirant stick composition, the composition being held on a product holding structure which is screw-fitted into a handle.

SUMMARY OF INVENTION

It is an object of the present invention to provide deodorant stick compositions with a dispensing means that can be reused multiple times, thereby reducing the amount of packaging, in particular plastic packaging involved in the use of the compositions.

Current deodorant stick compositions are generally packaged in plastic dispensers, the dispenser being used until composition is exhausted and then disposed of. The present invention enables the majority of the dispensing packaging to be reused with a new composition when the original one becomes exhausted. This greatly reduces the need packaging in using the invention.

It is an object of the present invention to provide a deodorant stick products that do not require an "elevator" mechanism for their operation.

Current deodorant stick products generally comprise a stick composition surrounded on all sides by a plastic container and having some means, typically a platform and an associated spindle, designed to elevate the stick composition out of the top of the plastic container. The present invention does not require the use any such platform or spindle, further reducing the need for packaging/dispensing materials.

In a first aspect of the invention, there is provided a packaged deodorant stick product comprising a deodorant stick composition mounted on an upper surface of a retaining member, a lower surface of the retaining member being reversibly connected to an upper surface of a holder enabling the deodorant stick product to be held in the human hand, wherein reversible connection between the retaining member and the holder is achieved by means of tongue and groove connection elements, characterised in that the tongue element extends at least partially across the lower surface of the retaining member or the upper surface of the holder and the groove element extends fully across the other of the lower surface of the retaining member or the upper surface of the holder and in that the product has an oval cross-section when viewed from above and the tongue and groove elements extend along the major axis of the oval cross-section of the product.

In a second aspect of the invention, there is provided a method of applying a deodorant stick composition to the surface of the human body by use of deodorant stick product according to the first aspect of the invention, particularly to deliver a deodorancy benefit or to reduce perspiration.

The holder enables the deodorant stick product to be easily held in one hand and for the composition to be applied to the desired surface.

A benefit of the invention is that the deodorant stick composition can be placed or replaced in its holder without need for hand contact with the deodorant stick composition.

DETAILED DESCRIPTION

Herein, features expressed as "preferred" with regard to a particular aspect of the invention should be understood to be preferred with regard to each aspect of the invention (likewise, features expressed as "more preferred" or "most preferred").

Herein, preferred features of the invention are particularly preferred when used in combination with other preferred features.

Herein, "ambient conditions" refers to about 20° C. and 1 atmosphere pressure, unless otherwise indicated.

Herein, all numbers, amounts and ratios may optionally be understood to be modified by the word "about", unless otherwise indicated.

Herein, the word "comprising" is intended to mean "including" but not necessarily "consisting of", i.e., it is non-exhaustive.

Herein, "cosmetic" methods and compositions should be understood to mean non-therapeutic methods and compositions, respectively.

Herein, locational terms, such as terms denoting relative positioning, such as "upper", lower", "top", "bottom", refer to the stick product orientated such the deodorant stick composition is immediately above its retaining member which is above the associated holder.

Herein, the term "deodorant stick composition" may be abbreviated to "deodorant stick" or simply "stick".

Deodorant sticks are capable of reducing body malodour following topical application. Topical application is typically achieved by drawing the top of the stick across the skin of the human body, particularly in the underarm regions.

The action of drawing the deodorant stick across the underarm regions places strong lateral forces on the stick, requiring it to have good physical strength and resistance to shear forces of this sort. The deodorant products of the present invention are especially designed to resist these forces.

Herein, deodorant sticks are typically antiperspirant stick compositions, i.e. antiperspirant sticks. Such sticks are capable of reducing perspiration, following topical application, as well as reducing body malodour. Herein, references to deodorant sticks should be understood to apply equally to antiperspirant sticks.

The deodorant sticks used in the invention are solid in nature, typically having a melting of greater than 40° C. at 1 atmosphere pressure. The deodorant stick preferably has a melting point at 1 atmosphere pressure of greater than 50° C. and more preferably greater than 60° C. Whether the melting point at 1 atmosphere pressure is greater than 40° C., 50° C. or 60° C., the melting point is preferably less than 90° C.

Herein, a deodorant stick is considered to have become molten when it is capable of flow solely under the influence of gravity and the melting point is defined as the temperature at which it becomes molten.

The deodorant stick preferably has a hardness of at least 600 gram force, most typically from 600 gram force to 5000 gram force, preferably from 750 gram force to 2000 gram force, more preferably from 800 gram force to 1400 gram force. This enables the stick to withstand the lateral forces encountered when it is topically applied. More particularly, it enables the stick to stay attached to its retaining member during such use.

Herein, the term "hardness" relates to how much force is required to move a penetration cone a specified distance and at a controlled rate into a deodorant stick composition under the following test conditions. Values are measured at 27° C., 15% relative humidity, using a TA-XT2 Texture Analyzer, available from Texture Technology Corp., Scarsdale, N.Y., USA. The product hardness value represents the peak force required to move a standard 45° angle penetration cone through the composition for a distance of 10 mm at a rate of 2 mm/second. The standard cone is available from Texture Technology Corp., as part number TA-15, and has a total cone length of about 24.7 mm, angled cone length of about 18.3 mm, a maximum diameter of the angled surface of the cone of about 15.5 mm. The cone is a smooth, stainless steel construction and weighs 17.8 grams.

Deodorant sticks of the invention typically do not require a plastic spindle running through them to aid in their elevation from their packaging; indeed, the absence of a central spindle running through the deodorant stick composition is a preferred feature of deodorant stick products of the present invention. The lack of a central spindle can have a detrimental effect of the structural strength of the stick and leads to relatively low preferred ratios of stick height to other dimensions (vide infra).

In preferred embodiments, the ratio of the height to the breadth of the deodorant stick composition is from 1:2 to 3:2. It is particularly preferred that this ratio is from 2:3 to 4:3. Having the height of the deodorant stick relative to the breadth of the deodorant stick within these ranges has been found to enhance the strength of retention of the stick composition within its retaining member during topical application of the stick composition.

Herein, "stick breadth" is the minimum cross-sectional diameter of the stick. For a stick having an oval cross-section, this equates to the minor axis of the oval.

Herein, "oval cross-section" is the cross-section when viewed from above.

In preferred embodiments, the ratio of the height of deodorant stick composition to the height of the holding material is from 1:2 to 3:2. It is particularly preferred that this ratio is from 2:3 to 1:1.

Herein, the "holding material" consists of the holder and the retaining matter and the height of the holding material includes the height of both of these components when they are engaged.

Having the height of the deodorant stick relative to the height of the holding material within these ranges has been found to enhance the strength of retention of the stick composition within its retaining member during topical application of the stick composition.

The deodorant stick composition is generally formed and attached to the retention member by a hot-fill process whereby molten product is typically poured into a mould, placed in contact with the retaining member whilst still molten and then allowed to cool to form a solidified stick composition attached to the retention member.

The retaining member holds the stick composition on its upper surface. Typically, the upper surface has protrusions rising into the stick to better aid its retention.

Preferably, the retaining member comprises one or more vents. Such vents may assist in the manufacture of the product. Such vents are holes, preferably elongated holes that pass fully through the retaining member from its upper surface to its lower surface.

When elongated holes are present in a product having an oval cross-section, it is preferred that these pass across the breadth of the retaining member in a direction parallel to the minor axis of oval-cross-section of the product.

In preferred embodiments, the retaining member comprises curved bridge structures which protrude upwards into the deodorant stick composition and aid retention of the composition. The composition is typically present above and below the bridge structures, making them embedded within the composition and enhancing the retention of the stick composition by the retaining member. The curved bridge elements may at least in part define elongated vents in the retaining member.

The lower surface of the retaining member bears a tongue or groove element designed to fit into a corresponding groove or tongue element, respectively, on the upper surface of the holder. Together, these features provide a reversible connection between the retaining member and the holder. This type of reversible connection has been found to be particularly convenient and reliable for sticks having an oval cross-section. In such sticks, the tongue and groove elements to run along the major axis of the oval.

Herein, the "tongue element" may be abbreviated to "tongue" and the "groove element" may be abbreviated to "groove".

The tongue and groove are elongated connection elements, the tongue being designed to slide into the groove. The tongue and groove provide a firm connection in directions other the one in which the tongue is slid into the groove.

The retention member, whether bearing the tongue or the groove on its lower surface, may move laterally relative to the holder along the lengthwise direction of the tongue and groove; however, once the tongue is engaged in the groove, the retaining member is axially immobile relative to the holder.

The tongue extends at least partially across the lower surface of the retaining member or the upper surface of the holder and the groove extends fully across the other of the lower surface of the retaining member or the upper surface of the holder.

The product has an oval cross-section and the tongue and groove extend along the major axis of the oval cross-section of the product. In particularly preferred embodiments, one of the tongue or the groove extends fully along the major axis of the lower surface of the retaining member and the other of the tongue or the groove extends fully along the major axis of the upper surface of the holder.

Having the tongue and groove located along the major axis of an oval cross-section of the product has been found to give enhanced retention of the retaining member by the holder, particular whilst the deodorant stick composition is being topically applied.

In typical embodiments, the deodorant stick composition and its associated retaining member may be slid from the holder by the application of a horizontal force in the direction of the long axis of the tongue and groove. This makes replacement of the deodorant stick and its associated retaining member particularly easy and convenient. Further, this may be done without the need for the consumer to make finger contact with the deodorant composition.

In particularly preferred embodiments, the tongue and/or groove comprises a retention bead serving to restrict lateral movement between the tongue and groove. The bead may protrude from the tongue and be held in a corresponding recession in the groove or vice versa. It will be understood that "lateral movement" between the tongue and groove means along their length.

In particularly preferred embodiments, the tongue depends from (i.e. is attached to) the lower surface of the retaining member and the groove is cut into the upper surface of the holder.

The holder is designed to reversibly connect with the retaining member by the means described above. It is also designed to allow the product to be held in the human hand. The holder enables easy application of the deodorant stick composition to the skin of the human body.

In preferred embodiments, the holder has a flat base. This allows the product to sit conveniently on a flat surface such as a bathroom shelf.

In preferred embodiments, the deodorant stick product comprises a cap which sits over the deodorant stick composition and contacts the holder.

The packaging components (e. g., cover, retaining member and holder) according to the present invention can be made of conventional materials for solid stick product packages (e.g. plastic materials). The packaging components can be made by conventional injection moulding techniques, with the material of construction preferably being a thermoplastic material having suitable rigidity to withstand forces which the device will experience when the product is filled by a hot-fill technique into the package and when the consumer uses the product. The materials of construction must be able to withstand hot-fill temperatures without deformation, having a heat of deformation of greater than 50° C., preferably greater than 60° C., more preferably greater than 70° C. and most preferably greater than 80° C. Exemplary of materials that may be used are polyolefins, such as polypropylene or polyethylene, in particular high density polyethylene.

SPECIFIC EMBODIMENT

Please note that these Figures are not necessarily drawn to the same scale.

Figure 1:
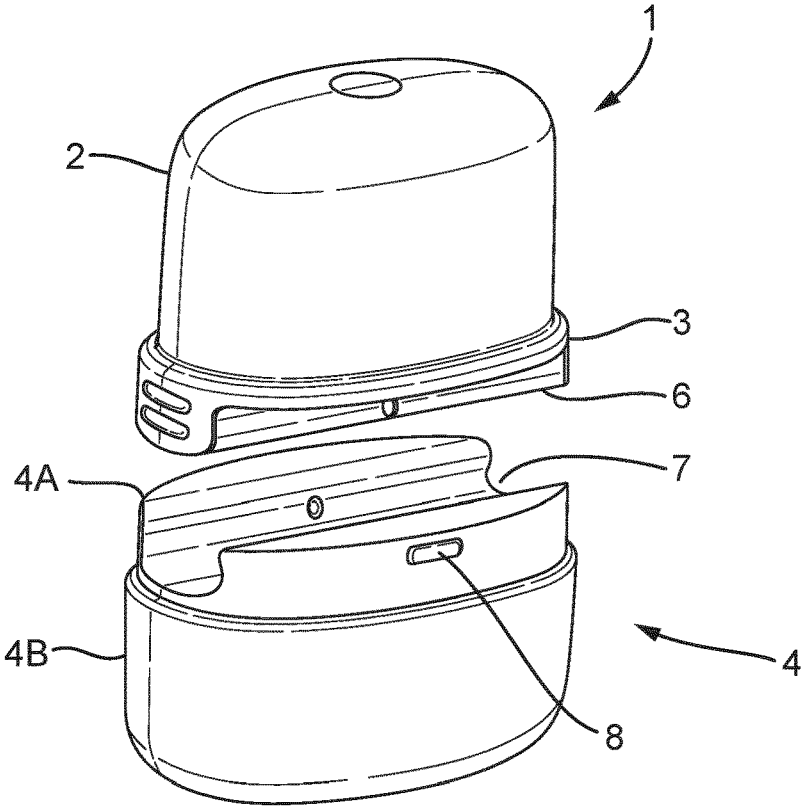
FIG. 1 is a perspective view of a deodorant stick product (1) according to the invention with the deodorant stick composition (2) and associated retaining member (3) separated from the holder (4).

FIG. 1 shows a deodorant stick composition (2) sat on an associated retaining member (3) separated from a holder (4) into which the retaining member (3) is designed to slot. When put together, a tongue (6) on the underside of the retaining member (3) is slotted into a groove (7) in the upper side of the holder (4). The holder (4) is comprised of two elements: an upper element (4A) in which the groove (7) sits and a lower element (4B) holding the upper element (4A). Typically, the upper element (4A) and the lower element (4B) are moulded independently and then fitted together.

Also illustrated in FIG. 1 is a small projection (8) from the side of the holder (4) designed to aid retention of a cap (5) and designed to fit over the deodorant stick composition (2).

Figure 2:
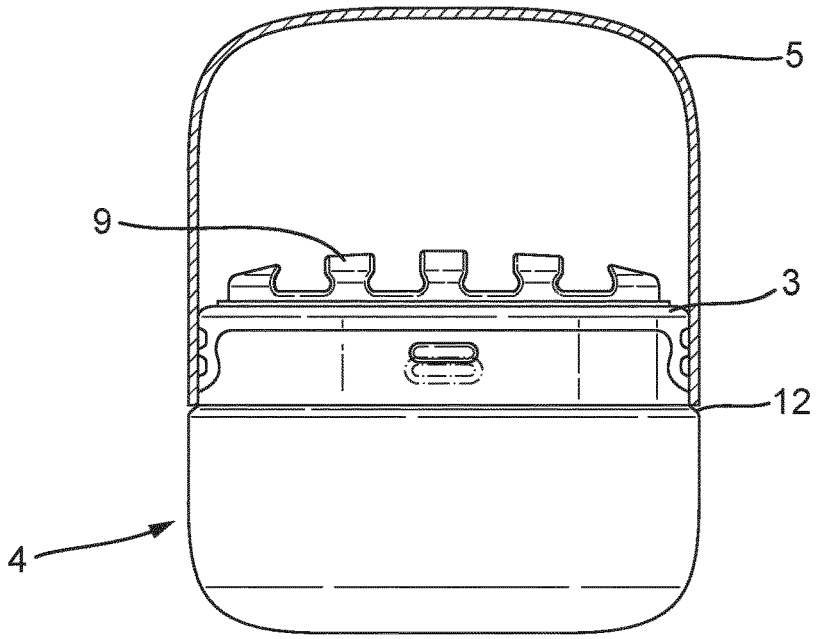
FIG. 2 is a front view of a deodorant stick product (1) as illustrated in FIG. 1 minus the deodorant stick composition and plus a cap (5) shown as partially transparent.

FIG. 2 illustrates the deodorant stick product (1) without its deodorant composition (2), but with a cap (5) shown over the space where the deodorant composition would sit and connecting with the holder (4). This Figure also illustrates bridge structures (9) that rise from the oval surround (3A) of the retaining member (3) and protrude into the deodorant stick composition (2) when it is in place. These bridge structures (9) serve to aid the retention of the composition (2) on the retaining member (3), particularly when the composition is being topically applied.

Figure 3:
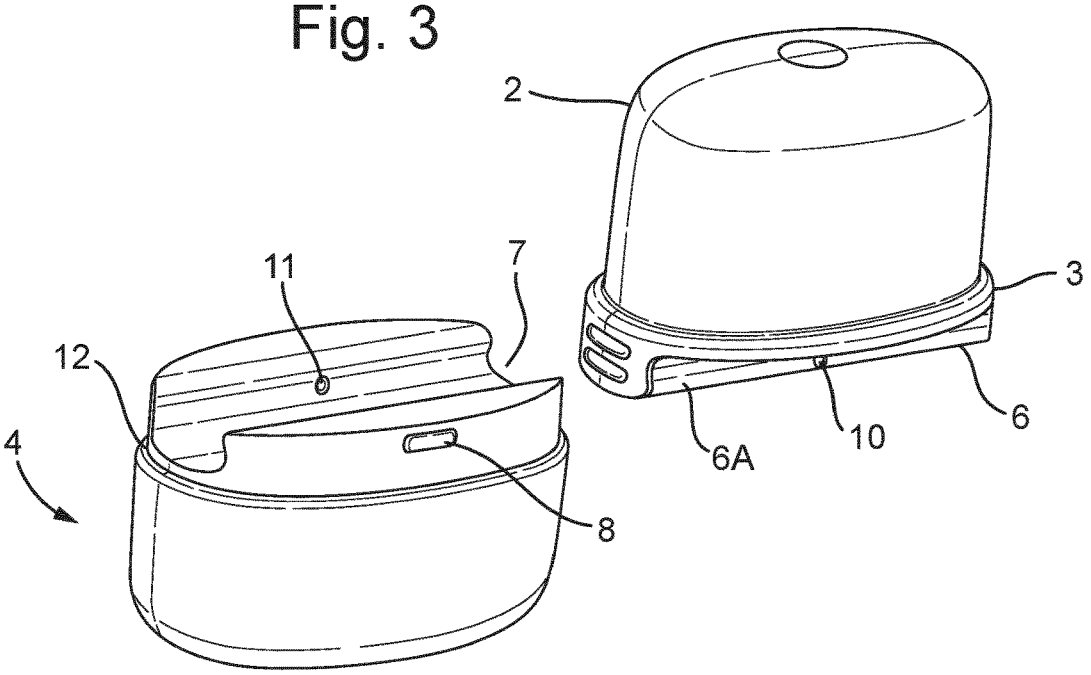
FIG. 3 is a perspective view of the deodorant stick composition (2), associated retaining member (3) and the separated holder (4) as illustrated in FIG. 1, with the retaining member (3) about to be slid into the holder (4).

FIG. 3 illustrates the deodorant stick composition (2) and its associated retaining member (3) slid out of the holder (4). Also illustrated are the tongue (6) and groove (7) features first illustrated in FIG. 1. FIG. 3 shows that the tongue (6) depending from the retaining member (3) bears a bead (10) which is designed to click into a hollow (11) in the groove (7) when the two are fully slotted together. The interaction between the bead (10) and the hollow (11) serve to aid the retention of the tongue (6) within the groove (7) and also provide a tactile and sometimes audible signal to the consumer of when the stick composition (2) and its associated retaining member (3) has been fully loaded into the holder (4).

Figure 4:
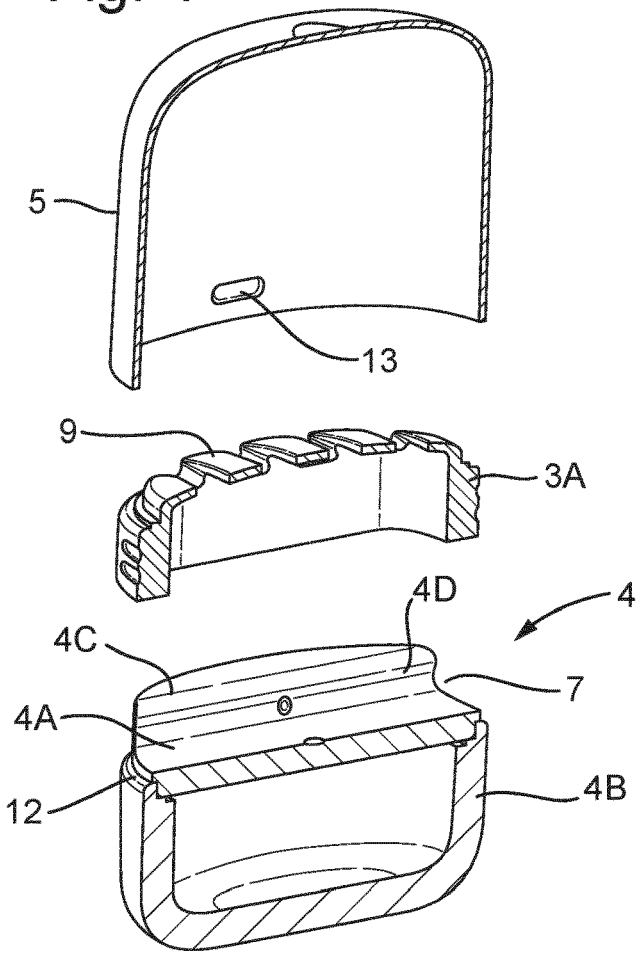
FIG. 4 is an exploded cross-sectional perspective view of the packaging elements illustrated in FIG. 2, again shown with the cap (5) shown as partially transparent.

Also illustrated in FIG. 3 is a ledge (12) around the outer perimeter of the holder (4). The lower edge of a cap (5), as illustrated in FIGS. 2 and 4, sits on this ledge (12) when such a cap (5) is employed. The ledge (12) is also illustrated and labelled in FIG. 2 and FIG. 4.

FIG. 4 shows cross-sections of each of the cap (5), the retaining member (3) and the holder (4), as illustrated in one or more of the previous figures. The cross-section of the cap (5) shows a retaining ring (13) on its inner surface, designed to accommodate the small projection (8) from the side of the holder (4) when the cap (5) is slid into place. The projection (8) from the side of the holder (4) and the retaining ring (13) on the inner surface of the cap (5) form a reversible "click-lock" retaining means for the cap (5) on the holder (4).

FIG. 4 also illustrates the bridges structures (9) of the retaining member (3) in more detail. These key features arc upwards from an oval surround (3A) of the retaining member (3) into the deodorant stick composition (2), enhancing its retention.

FIG. 4 also illustrates the holder (4) in more detail. As previously mentioned, it is comprised of two elements, including the upper element (4A) in which the groove (7) sits. The groove (7) is in part defined by opposing internal walls (4C) of the holder (4), specifically of the upper element (4A) of the holder (4). The opposing internal walls (4C) have a concave surfaces (4D) along the length of the groove (7). These walls (4C) are designed to accommodate corresponding convex surfaces (6A) of the tongue (6) depending from the retaining means (3), as illustrated in FIG. 3. The concave surfaces (4D) and convex surfaces (6A) are such that the tongue (6) fits closely into the groove (7), enhancing the quality of retention between the retention member (3) and the holder (4).

The invention claimed is:

1. A packaged deodorant stick product comprising:

a deodorant stick composition; and a retaining member, wherein the deodorant stick composition is mounted on an upper surface of the retaining member, wherein a lower surface of the retaining member is configured to be reversibly connected to an upper surface of a holder enabling the deodorant stick product to be held in a human hand, wherein reversible connection between the retaining member and the holder is achieved by tongue and groove connection elements, wherein the tongue element extends at least partially across the lower surface of the retaining member or the upper surface of the holder, wherein the groove element extends fully across the other of the lower surface of the retaining member or the upper surface of the holder, wherein the tongue and groove elements extend along a major axis of the oval cross-section of the product, and wherein the deodorant stick product has an oval cross-section when viewed from above.

2. A deodorant stick product according to claim 1, wherein the tongue and/or groove element comprises a retention bead serving to restrict lateral movement therebetween.

3. A deodorant stick product according to according to claim 1, comprising a cap which sits over the deodorant stick composition and contacts the holder.

4. A deodorant stick product according to claim 1, wherein the ratio of the height of deodorant stick composition to the height of the holder is from 1:2 to 3:2.

5. A deodorant stick product according to claim 1, wherein the ratio of the height to the breadth of the deodorant stick composition is from 1:2 to 3:2.

6. A deodorant stick product according to claim 1, wherein the tongue element depends from the lower surface of the retaining member and the groove element is cut into the upper surface of the holder.

7. A deodorant stick product according to claim 1, wherein the deodorant stick composition is an antiperspirant composition.

8. A deodorant stick product according to claim 1, wherein the deodorant stick composition has a hardness of at least 600 gram force.

9. A deodorant stick product according to claim 1, wherein the retaining member comprises curved bridge structures which protrude upwards into the deodorant stick composition.

10. A deodorant stick product according to claim 9, wherein the curved bridge structures are embedded in the deodorant stick composition.

11. A method of applying a deodorant stick composition to a surface of a human body comprising the topical application of a product according to claim 1.

* * * * *